US007047782B2

(12) United States Patent
Teshima et al.

(10) Patent No.: US 7,047,782 B2
(45) Date of Patent: May 23, 2006

(54) METHOD FOR ROLL FORMING, CAPABLE OF PREVENTING WRINKLES AND DEVICE THEREFOR

(75) Inventors: Kuniharu Teshima, Kariya (JP); Kazuhiro Mitsukawa, Bisai (JP); Shoichi Takenouchi, Toyota (JP)

(73) Assignee: DENSO Corporation, Kariya (JP)

( * ) Notice: Subject to any disclaimer, the term of this patent is extended or adjusted under 35 U.S.C. 154(b) by 164 days.

(21) Appl. No.: 10/767,970

(22) Filed: Jan. 28, 2004

(65) Prior Publication Data

US 2004/0182124 A1 Sep. 23, 2004

(30) Foreign Application Priority Data

Feb. 3, 2003 (JP) ..... 2003-026290

(51) Int. Cl.
*B21B 21/00* (2006.01)

(52) U.S. Cl. ..... 72/191; 72/76; 72/176; 72/182; 72/184; 72/190; 72/193; 72/194; 72/196; 72/197; 72/198; 72/192; 72/465.1; 72/466.8

(58) Field of Classification Search ..... 72/176, 72/182, 184, 190, 191, 197, 465.1, 466.8, 72/76, 193, 194, 198, 196, 192
See application file for complete search history.

(56) References Cited

U.S. PATENT DOCUMENTS

| | | | | |
|---|---|---|---|---|
| 3,040,799 | A * | 6/1962 | Hanson | 72/57 |
| 3,150,707 | A * | 9/1964 | Howell | 72/177 |
| 3,828,632 | A * | 8/1974 | Grano | 83/345 |
| 6,339,947 | B1 | 1/2002 | Bodnar | |

FOREIGN PATENT DOCUMENTS

| | | | | |
|---|---|---|---|---|
| JP | 62214835 | A * | 9/1987 | 83/684 |

* cited by examiner

*Primary Examiner*—Derris H. Banks
*Assistant Examiner*—Hung C. Le
(74) *Attorney, Agent, or Firm*—Harness, Dickey & Pierce, PLC

(57) ABSTRACT

A die roll 3 comprises a core part 3*a* which is formed of an elastic material and faces a punch part 2*a* of a punch roll 2. The core part 3*a* presses a bottom portion 4*b* of a drawn portion 4*a* of a metal material 4 and is separate from a surrounding die part 3*b* and is provided with a space 3*c* at the whole outer periphery of the core part 3*a*. In accordance with the above configuration, swelling is suppressed at the bottom portion 4*b* of the drawn portion 4*a* and production of large wrinkles, which is a reason for folds, can be prevented by increase of pressing areas for preventing wrinkles at both sides of the drawn portion.

5 Claims, 9 Drawing Sheets

ENLARGED VIEW

"A-A" SECTION

"C-C" SECTION

"D-D" SECTION

METHOD FOR ROLL FORMING, CAPABLE OF PREVENTING WRINKLES AND DEVICE THEREFOR

BACKGROUND OF THE INVENTION

1. Field of the Invention

The present invention relates to a roll forming method and a roll forming device for draw forming sheet metal materials 2. Description of the Related Art A need exists for speeding up forming processes, in view of cost-cutting and, in order to realize the need, a continuous roll forming process preferably replaces an intermittent press forming process. However, in the case of prior art roll forming, as shown in FIG. 7, as each outer surface of rotating upper and lower rolls (punch roll 100 and die roll 200) forms a cylindrically curved surface, both roll 100 and roll 200, and a sheet metal material 300 are allowed to make a line contact, but are not allowed to make a plane to plane contact as is performed by using pressing (blank holding) pads for preventing wrinkles in the press forming. Meanwhile, the punch roll 100 is provided with a punch 110 corresponding to a drawn shape and the die roll 200 is provided with a corresponding concaved die 210 engaging the punch 110.

For the above reason, while the draw forming is performed on a thin metal material having a wall thickness less than 0.20 mm by the roll forming, due to a small stiffness of the thin material, it is very difficult to get satisfactory performance of the draw forming in the same number of steps as that of the steps in a press forming process. That is to say, as fewer steps in the roll forming process cause, as shown in the FIG. 8 and FIG. 9A, an excessive drawn strain of a material 300 (drawn displacement $d_0$) in the course of the forming process, a swelling 311 is produced at the central part of a formed portion 310. FIG. 9A is a plan view of a process of roll forming and FIG. 9B is a perspective view of process of roll forming. In consequence, at both sides 320 (flange areas) of the drawn portion 310, wrinkles 330 are produced and result in folds 340 (ref. to FIG. 9C, FIG. 9D, FIG. 9E). FIG. 9C is a plan view of after a process of the roll forming and FIG. 9D is a magnified view of portion E in FIG. 9C after the process of roll forming and FIG. 9E is a perspective view after the process of roll forming. It is thus necessary to perform the draw forming step by step to avoid producing wrinkles 330. The number of steps in the roll forming process is more than double compared to that of the steps in the press forming process.

On the other hand, a roll forming apparatus as described, for example, in U.S. Pat. No. 6,339,947 is known and described later, this roll forming apparatus has a punch on a flat platen segment which rotates and changes the direction of motion by a cam mechanism and can prevent production of wrinkles.

The roll of forming apparatus as described in the above Patent, however, has a very complicated mechanism and accordingly incurs a substantial increase in cost.

BRIEF SUMMARY OF THE INVENTION

The present invention has been developed with the above-mentioned problem being taken into consideration, and the object is to provide a novel roll forming method which performs draw forming of a thin wall metal material with fewer steps in the forming process and without any defective fold and a device performing the roll forming method. Thus it is not necessary to use a complicated mechanism containing a cam mechanism etc. for prevention of wrinkles in the draw forming of the thin wall metal material by using the roll forming method and the device.

(A first aspect of the present invention)

A roll forming device comprises a punch roll having a punch part and a die roll, and performs draw forming on a sheet metal material which is passed between the punch roll and the die roll and, at the same time, is pressed by the punch part of the punch roll into the corresponding die roll. The die roll is provided with a core part which faces the corresponding punch part and presses a bottom portion of a drawn portion which is a part of the sheet metal material and is formed on the sheet metal material by draw forming. The core part is formed of an elastic material and is separate from a surrounding die part.

According to the above configuration, while the sheet metal material is pressed by the punch part, the core part presses the bottom portion of the drawn portion. In consequence, drawn strain (displacement) at both sides of the drawn portion of the sheet metal material is reduced and, as a result, a swelling formed on the bottom portion of the drawn portion can be prevented. The drawn strain is produced by narrowing the width of the sheet metal material. Furthermore as the core part is separate from the surrounding die part, it is possible that only the core part is compressed and deformed independently of the surrounding die part according as the punch part presses. Therefore the surrounding die part is not much deformed due to compression of the core part and then the pressing (blank holding) areas for preventing wrinkles thus can be increased at flange areas (at the both sides of the drawn portion) of the sheet metal material.

(A second aspect of the present invention)

In a second aspect according to the first aspect of the roll forming device of the present invention, the die roll is provided with a space at the outside periphery of the core part facing to the die part.

(A third aspect of the present invention)

In a third aspect according to the second aspect of the roll forming device of the present invention, the core part comprises the space at the entire periphery thereof. In this case, compressive deformation of the core part can be absorbed in the space formed on the entire periphery thereof so that effect on the surrounding die part due to the compressive deformation of the core part can be reduced to a minimum.

(A fourth aspect of the present invention)

Any one of the roll forming devices of the first to the third aspects of the invention performs draw forming of the sheet metal material having a wall thickness less than 0.20 mm.

The thinner the wall thickness becomes, the smaller a stiffness of the sheet metal material becomes and, therefore, wrinkles tend to be produced at both sides of the drawn portion during the draw forming process. On the other hand, the roll forming device according to the present invention can prevent the production of the wrinkles and the draw forming process can be performed in a minimum processing steps, while the draw forming is performed on the thin sheet metal material.

(A fifth aspect of the present invention)

A roll forming method which performs draw forming on a sheet metal material employs any one of the roll forming devices of the first to the fourth aspects of the invention. The draw forming is performed, while the core part, separate from the surrounding die part of the die roll, presses the bottom portion of the drawn portion formed on the sheet metal material. According to the said method, while the sheet metal material is pressed by the punch part, the core part can press the bottom portion of the drawn portion. In consequence, the drawn strain at both sides of the drawn portion of the sheet metal material is reduced and, as a result, a swelling on the bottom portion of the drawn portion can be prevented.

Furthermore as the core part is separate from the surrounding die part, it is possible that only the core part is compressed and deformed independently of the surrounding die part as the punch part presses. Therefore the surrounding die part is hardly deformed by compression of the core part and the pressing areas for preventing wrinkles can be thus increased at flange areas (at the both sides of the drawn portion) of the sheet metal material. Furthermore as the core part is provided with a space surrounding the core part itself, while the core part is pressed and compressed to deform by the punch part, the compressive deformation of the core part can be absorbed in the space so that the deformation of the surrounding die part can be reduced in spite of the effect of the compressive deformation of the core part.

The present invention may be more fully understood from the description of the preferred embodiments of the invention set forth below, together with the accompanying drawings.

DESCRIPTION OF THE PREFERRED EMBODIMENTS

Figure 1A:
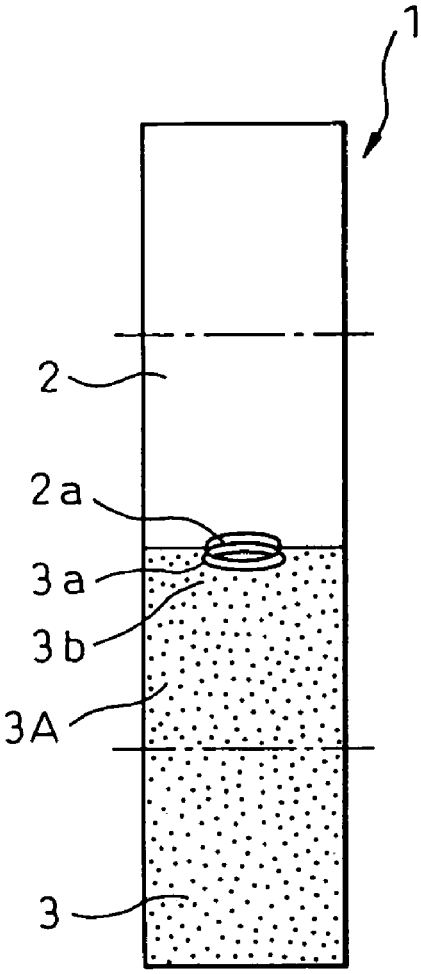
FIG. 1A is a front view of a roll forming device.

Next, the embodiment of the present invention is described with reference to the drawing.

(First Embodiment)

Figure 1B:
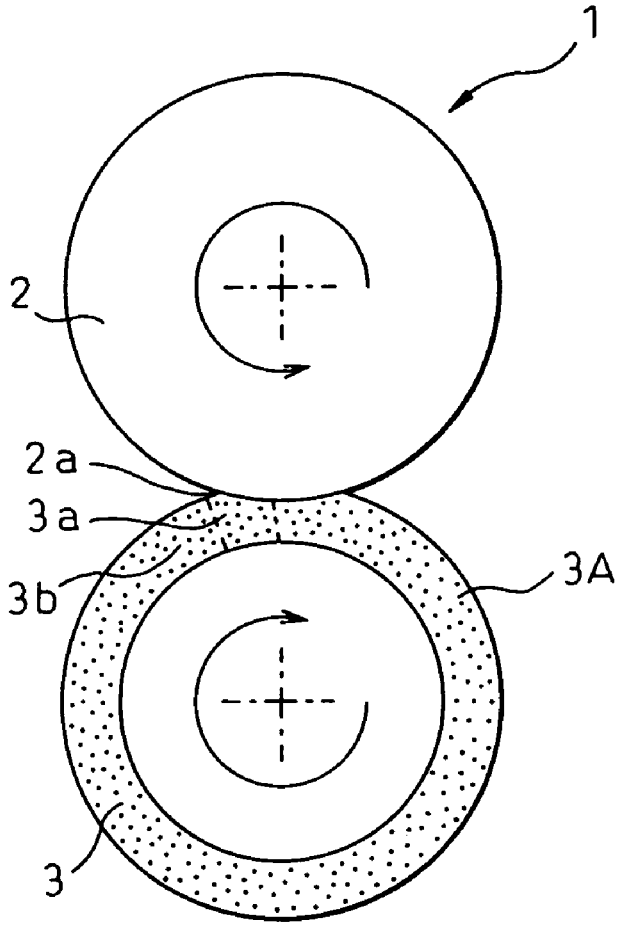
FIG. 1B is a side view of the roll forming device.
Figure 2A:
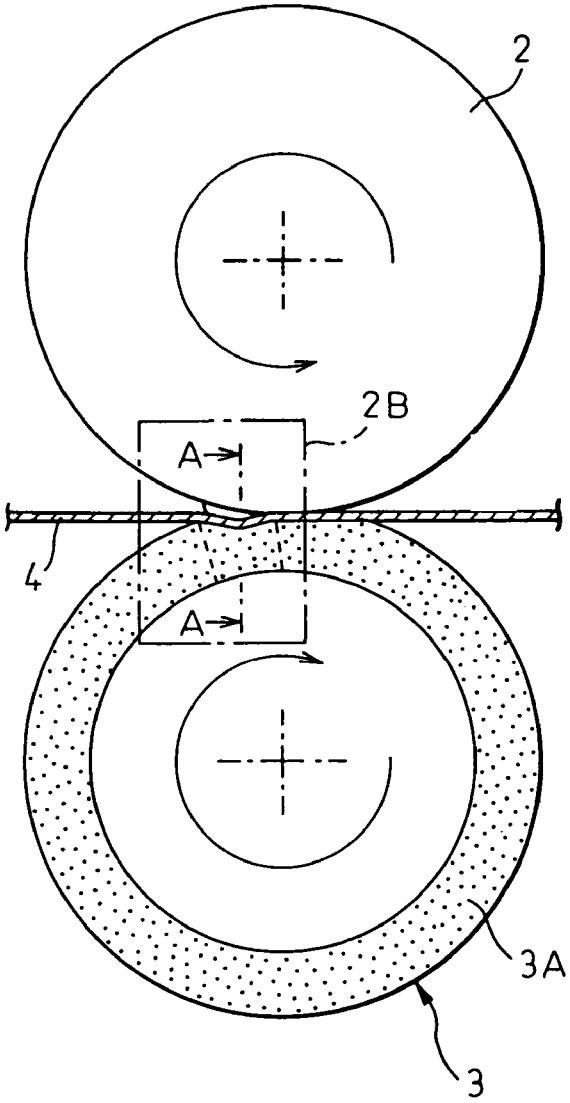
FIG. 2A is a side view of the roll forming device showing process of draw forming.

FIGS. 1A and 1B illustrate a front view and a side view of a roll forming device 1, respectively. The roll forming device 1 of the present embodiment comprises a punch roll 2 and a die roll 3 and performs draw forming, as shown in FIG. 2, on a sheet metal material 4 which is passed between both rolls 2 and 3. The metal material 4 is formed, for example, into a plate material 4A (wall thickness less than 0.20 mm) in use of a stacked-plate type heat exchanger. A tank portion 40 is formed by the draw forming at an end of the plate 4A, as shown in FIG. 3.

A punch roll 2 is, for instance, made of metal and is provided with a punch part 2*a* (circular boss in the embodiment) which performs draw forming on the outer surface of the metal material. At least a surface layer of the die roll 3 is formed with an elastic material 3A (e.g. urethane), as shown in FIG. 1B. The elastic material 3A is provided with a core part 3*a* located in a hole facing the punch part 2*a*. The core part 3*a* formed of an elastic material, as shown in FIG. 2C, presses a bottom portion 4*b* of a drawn portion 4*a*, which is a part of the metal material 4 and is formed by draw forming, and is separate from a surrounding die part 3*b*. Furthermore a space 3*c* is provided at the entire outer periphery of the core part 3*a* facing the die part 3*b*.

Next, the functions and effects of the present embodiment are described.

Figure 4A:
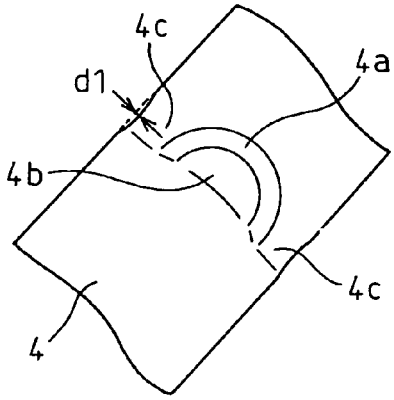
FIG. 4A is a plan view showing a metal material in process.
Figure 4C:
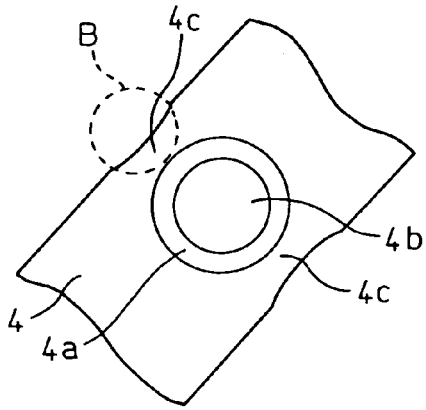
FIG. 4C is a plan view showing the metal material after process.
Figure 4D:
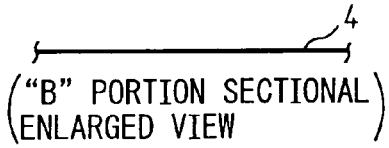
FIG. 4D is a magnified sectional view of portion B in FIG. 4C.
Figure 4B:
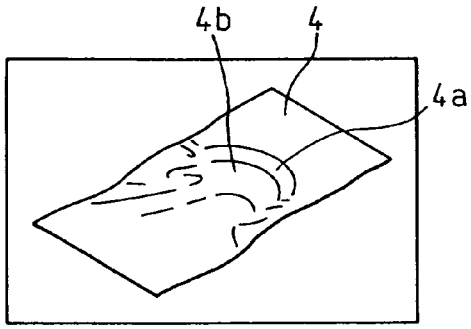
FIG. 4B is a perspective view showing the metal material in process.
Figure 8:
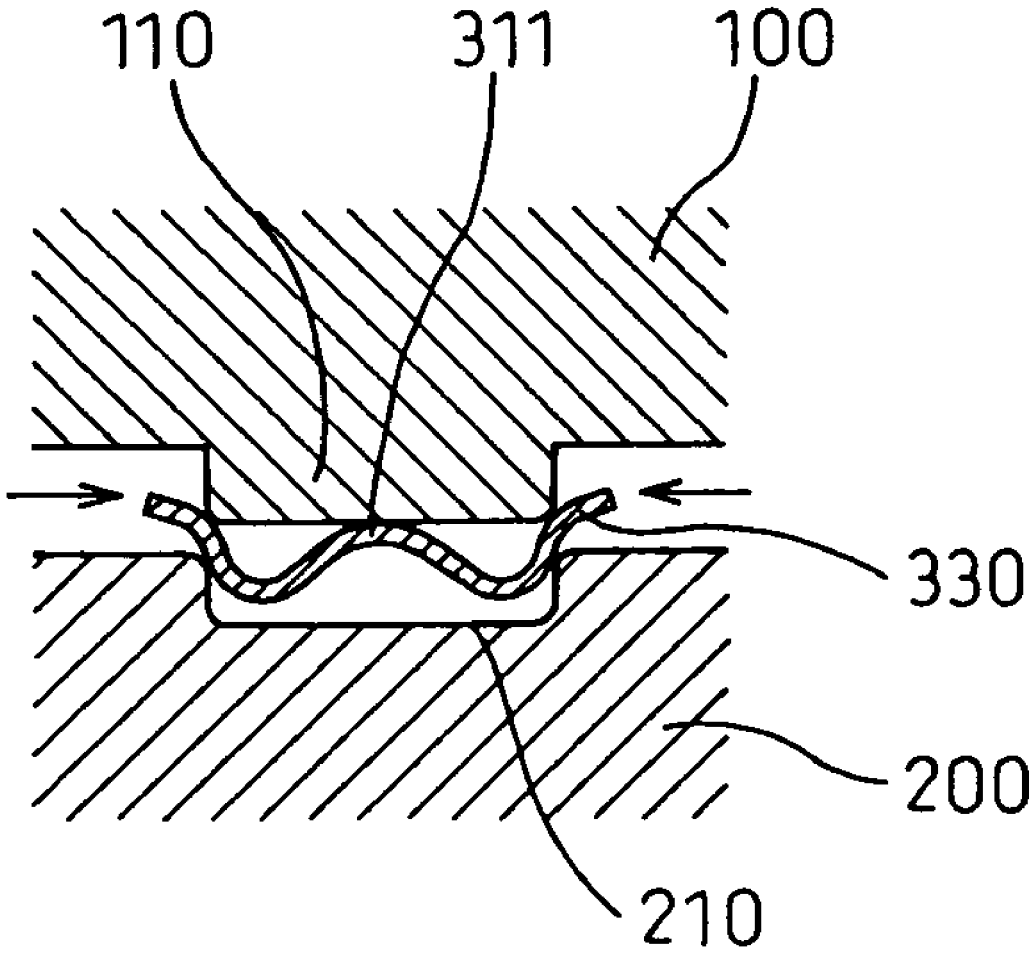
Fig. 8 PRIOR ART
FIG. 8 is a cross-sectional view taken along D—D in FIG. 7B (prior art).
Figure 9A:
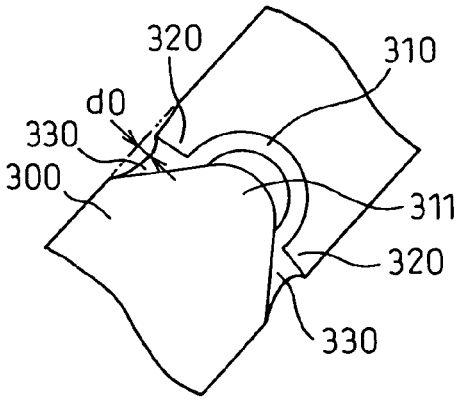
Fig.9A PRIOR ART
FIG. 9A is a plan view showing a metal material in process (prior art).
Figure 9C:
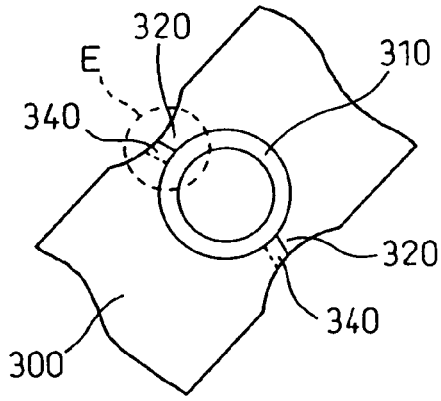
Fig.9C PRIOR ART
FIG. 9C is a plan view showing the metal material after process (prior art).
Figure 9D:
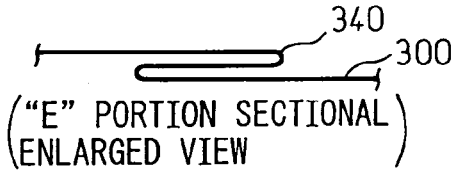
Fig.9D PRIOR ART
FIG. 9D is a magnified sectional view at portion E in FIG. 9C (prior art).
Figure 9B:
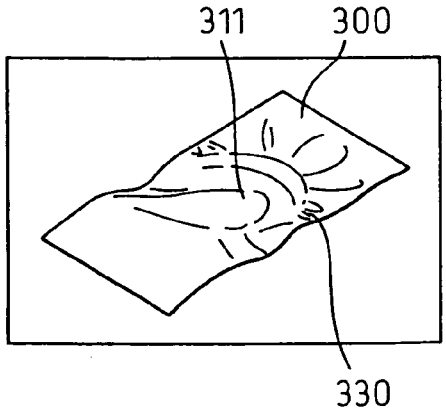
Fig.9B PRIOR ART
FIG. 9B is a perspective view showing the metal material (prior art).
Figure 9E:
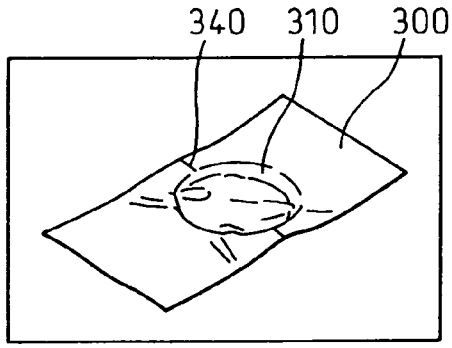
Fig.9E PRIOR ART
FIG. 9E is a perspective view showing the metal material after process (prior art).

When draw forming is performed by roll forming, the thinner the wall thickness of a metal material 4 becomes, the smaller the stiffness of the metal material 4 becomes and, therefore, as shown in FIG. 4A and FIG. 4B, wrinkles tend to be produced at both sides 4*c* of the drawn portion 4*a*. FIG. 4A is a plan view and FIG. 4B is a perspective view. These wrinkles are produced as a swelling (refer to FIG. 8) is produced at a central part of the bottom portion 4*b* of the drawn portion 4*a* while the metal material 4 is pressed by the punch part 2*a* and is drawn excessively.

Figure 2B:
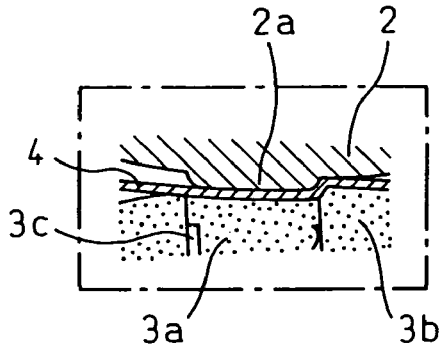
FIG. 2B is a magnified sectional view of a formed portion.
Figure 2C:
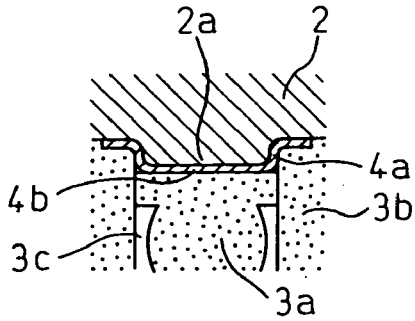
FIG. 2C is a cross-sectional view taken along A—A of the formed portion in FIG. 2A.
Figure 3:
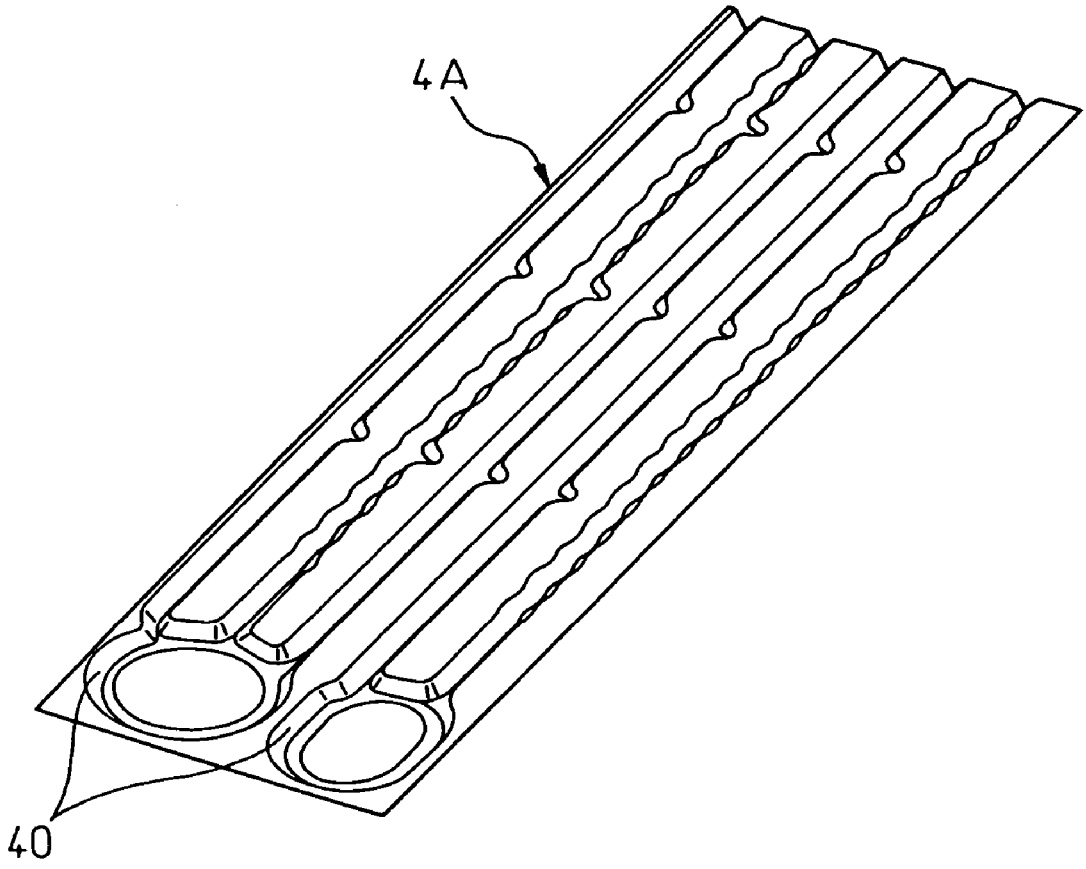
FIG. 3 is a perspective view of a plate material.
Figure 4E:
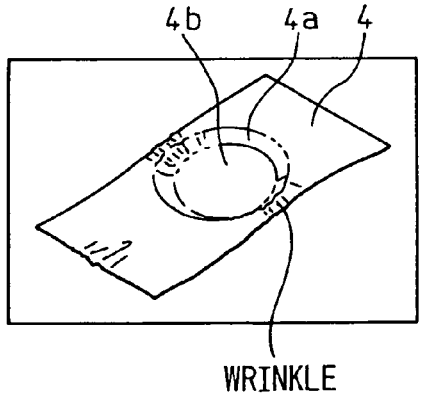
FIG. 4E is a perspective view showing the metal material after process.

On the contrary, as the roll forming device 1 of the present embodiment is provided with the core part 3*a* in the die roll 3, the core part 3*a* can press the bottom portion 4*b* of the drawn portion while, as shown in FIG. 2B and FIG. 2C, the metal material 4 is pressed by the punch part 2*a*. As a result, as shown in FIG. 4A, the drawn displacement d1 (d1 is smaller than d0) of drawn strain on the both sides 4*c* of the drawn portion in process is reduced. Finally a swelling on the bottom portion 4*b* of the drawn portion is prevented (refer to FIG. 4C, FIG. 4D and FIG. 4E). Hereon, FIG. 4C is a plan view, FIG. 4D is a magnified sectional view at portion B in FIG. 4C and FIG. 4E is a perspective view.

Figure 5A:
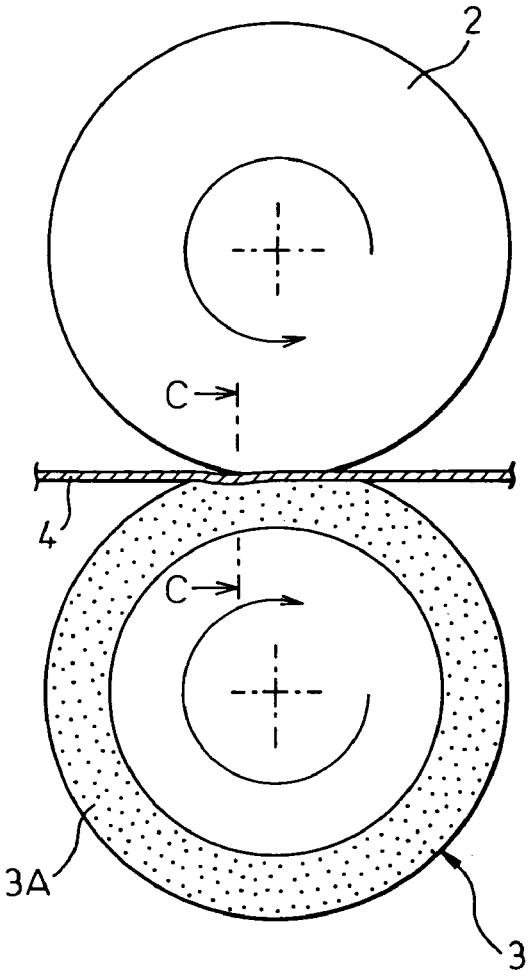
FIG. 5A is a side view of a roll forming device.
Figure 5B:
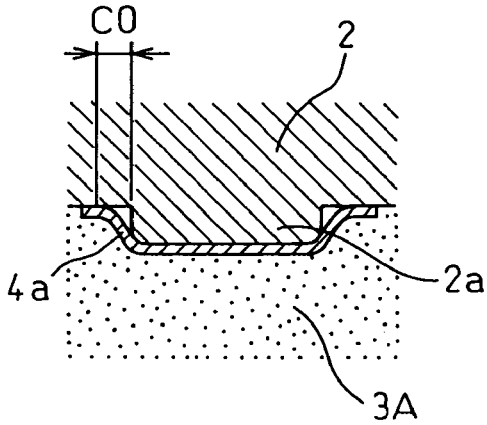
FIG. 5B is a cross-sectional view taken along C—C of a formed portion in FIG. 5A.

On the other hand, it is essential to increase the pressing areas for preventing wrinkles at the both sides 4*c* of the drawn portion in order to prevent production of wrinkles. Though the elastic material 3A is provided on the die roll 3, in the case that the core part 3*a* and the die part 3*b* are integrated (refer to FIG. 5A), while the metal material 4 is pressed into the elastic material 3A by the punch part 2*a*, compressive deformation of the core part 3*a* influences the surrounding die part 3*b* and, therefore, a gap C0 is produced between the side of the drawn portion 4*a* of the metal material 4 and the side of the punch part 2*a*, as shown in FIG. 5B. For this reason, the pressing areas for preventing wrinkles can not be increased at the both sides 4*c* of the drawn portion.

On the other hand, the die roll 3 of the present embodiment is provided with the core part 3*a* which is separate from the surrounding die part 3*b* and, therefore, the core part 3*a* can be compressed and deformed independently of the die part 3*b* as the punch part 2*a* presses. The surrounding die part 3*b* is hardly deformed by compression of the core part 3*a* and the pressing areas for preventing wrinkles thus can be increased at the both sides 4*c* of the drawn portion of the metal material 4.

Figure 6A:
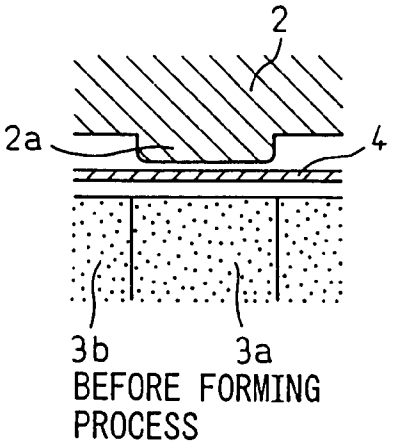
FIG. 6A shows cross-sectional views of area near a core part without a space therearound for comparison between before process and in process.
Figure 6A:
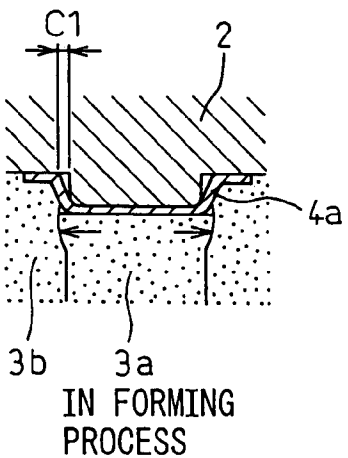

However, as shown in FIG. 6A, in case that the core part 3*a* is arranged closely adjacent to the die part 3*b* (there is no space 3*c* on the outer periphery of the core part 3*a*), while the core part 3*a* is pressed and compressed to deform by the punch part 2*a*, the surrounding die part 3*b* is directly influenced by the deformation. As a result, the surrounding die part 3*b* is remarkably pressed down along with compressive deformation of the core part 3*a*, then a gap C1 C1 is smaller than C0) is produced between the metal material 4 and the punch part 2*a*.

Figure 6B:
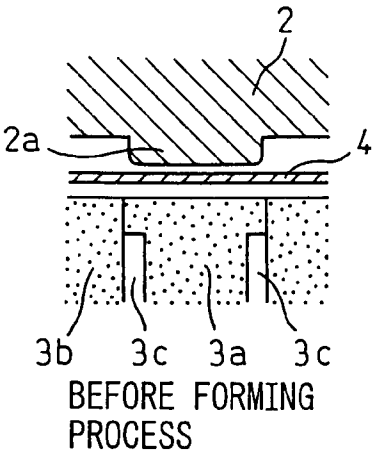
FIG. 6B shows cross-sectional views of area near a core part with a space therearound for comparison between before process and in process.
Figure 6B:
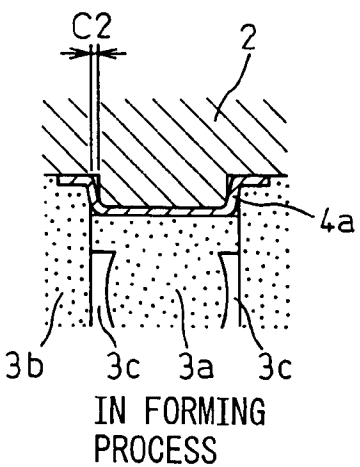
Figure 6C:
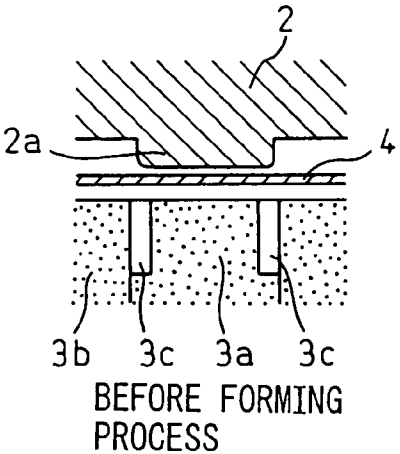
FIG. 6C shows cross-sectional views of area near another core part with a space therearound for comparison between before process and in process.
Figure 6C:
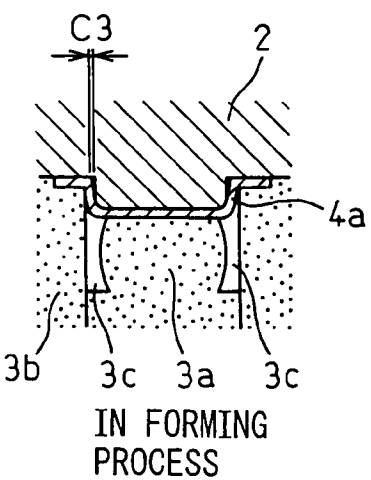
Figure 7A:
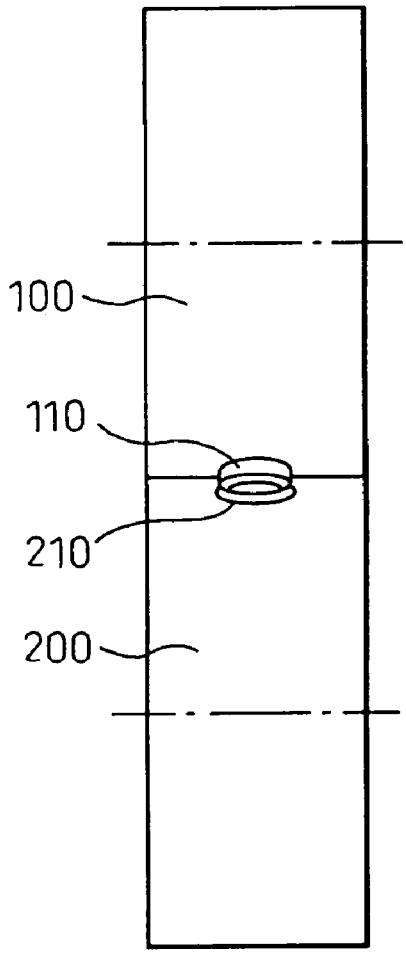
Fig.7A PRIOR ART
FIG. 7A is a front view of a roll forming device of prior art.
Figure 7B:
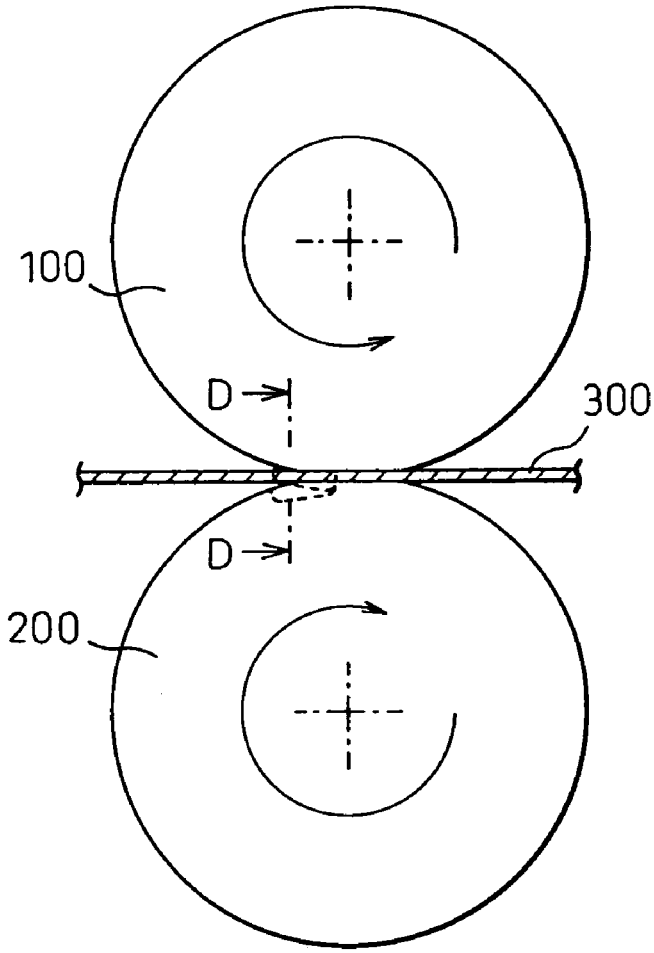
Fig.7B PRIOR ART
FIG. 7B is a side view of the roll forming device of prior art.

On the other hand, as shown in FIG. 6B and FIG. 6C, in case that the core part 3*a* is provided with the space 3*c* on the outer periphery thereof (the entire periphery), while the core part 3*a* is pressed and compressed to deform by the punch part 2*a*, the produced deformation of the core part 3*a* can be absorbed in the space 3*c* and the deformation of the surrounding die part 3*b*, due to compressive deformation of the core part 3*a*, can be reduced. As a result, as each gap C2 and C3 (each about a half of C0) produced between the metal material 4 and the punch part 2*a* can be reduced, the pressing areas for preventing wrinkles can be greatly increased.

Meanwhile, the space 3*c* provided at the outer periphery of the core part 3*a* may be provided either at the radially inside of the core part 3*a*, as shown in FIG. 6B, or radially outside thereof, as shown in FIG. 6C. In this regard, in fact a gap C3 formed when using the core part 3*a* shown in FIG. 6C was smaller than a gap C2 formed when using the core part 3*a* shown in FIG. 6B.

According to the above description, the roll forming device 1 in the present embodiment, as shown in FIGS. 4A to E, can reduce the swelling at the bottom portion 4*b* of the drawn portion of the metal material 4 and can prevent production of large wrinkles, which is a reason for folds, by increasing the pressing areas for preventing wrinkles at the both sides 4*c* of the drawn portion. Thus, without employing a complicated mechanism containing a cam mechanism etc., the roll forming device in the present embodiment can perform draw forming free of folds on the thin wall metal material 4 in a minimum number of forming steps and can considerably lower the cost.

Further, the elastic material 3A used for the die roll 3 is not limited to urethane, but a synthetic rubber, such as silicone rubber, may be applicable. In the above-mentioned embodiment, the die roll 3 may be made of a metal.

While the invention has been described by reference to specific embodiments chosen for the purposes of illustration, it should be apparent that numerous modifications could be made thereto by those skilled in the art without departing from the basic concept and scope of the invention.

The invention claimed is:

1. A roll forming device comprising:

a punch roll having a punch part;

a die roll having a surface layer and a hole on the surface layer which accepts the punch part; and a core part disposed within the hole; wherein draw forming is performed on a sheet metal material when it is passed between the punch roll and the die roll, the sheet metal material being pressed by the punch part into the hole of the die roll;

the core part in the hole is formed of an elastic material separate from the surrounding die part on the surface layer and faces the punch part; and the core part presses a bottom portion of a drawn portion which is a part of the sheet metal material and formed on the sheet metal material by using a separate portion between the die part and the core part.

2. A roll forming device set forth in claim 1, wherein the die roll is provided with a space between the outer periphery of the core part and the die part.

3. A roll forming device set forth in claim 2, wherein the space is at the entire periphery of the core part.

4. A roll forming device set forth in claim 1, wherein draw forming is performed on the metal material of wall thickness less than 0.20 mm.

5. A roll forming method performing draw forming on the sheet metal material by using the roll forming device set forth in claim 1; wherein the core part, separate from the die part of the die roll, presses the bottom portion of the drawn portion formed on the metal material so as to perform the draw forming.

* * * * *